United States Patent [19]

Kamayachi

[11] Patent Number: 4,878,489

[45] Date of Patent: Nov. 7, 1989

[54] MASSAGE UNIT

[75] Inventor: Yuzo Kamayachi, Tokyo, Japan

[73] Assignee: Tensho Electric Industrial Co., Ltd., Tokyo, Japan

[21] Appl. No.: 217,580

[22] Filed: Jul. 11, 1988

[51] Int. Cl.[4] ..... A61H 1/00

[52] U.S. Cl. ..... 128/36; 128/35

[58] Field of Search ..... 128/32, 34–37

[56] References Cited

U.S. PATENT DOCUMENTS

| | | | |
|---|---|---|---|
| 750,735 | 1/1904 | Turck | 128/36 |
| 2,675,800 | 4/1954 | Voorhees | 128/36 |
| 3,451,391 | 6/1969 | Tavel | 128/36 |
| 3,464,405 | 9/1969 | Kallus | 128/36 |
| 3,580,246 | 5/1971 | Foreman | 128/36 |
| 3,601,121 | 8/1971 | Roberts | 128/34 |
| 4,007,735 | 2/1977 | Magnusson | 128/37 |
| 4,604,993 | 8/1986 | Moriwaki et al. | 128/36 |

FOREIGN PATENT DOCUMENTS

| | | | |
|---|---|---|---|
| 2116430 | 9/1983 | United Kingdom | 128/32 |

*Primary Examiner*—David A. Wiecking
*Assistant Examiner*—Huong Q. Pham
*Attorney, Agent, or Firm*—Wenderoth, Lind & Ponack

[57] ABSTRACT

The present invention relates to a massage unit, which contains a vibrator within a flexible long cylindrical piece, so that the user can hold both ends of the unit and apply it freely to any desired site of the body, which could not be reached by the conventional massage unit without the help of another person. The unit can be held on the affected site, and the user can continue office work, cooking or learning, while enjoying the effects of massage. Since the user finds no difficulty in applying and holding the unit to the affected site, the unit can offer more effective massage effects in relaxing the muscle stiffness, enhancing blood circulation, etc. In one embodiment the long massage unit can be bent to any desired shape, which shape is retained by a plastically deformable metal, such that the user can apply the bent long massage unit around any part of the body without having to continue holding the massage unit.

5 Claims, 2 Drawing Sheets

MASSAGE UNIT

BACKGROUND OF THE INVENTION

The conventional massage units were roughly divided into the following types: The relatively compact, lightweight massage unit of handy type, which contains a vibrator. The user holds the unit by hand and attaches it to the desired affected site such as shoulder, waist, leg, arm, etc.; A unit with larger dimension, which consists of a massage block made of a movable pushing material mounted on the backrest of a chair, whereby the neck, shoulder and back of the user are massaged; A large-scale massage unit, which contains a massage block provided with a freely movable roller on mattress or a bed piece so that the user lays himself or (herself) down on it, facing upward, and is massaged by the unit.

SUMMARY OF THE INVENTION

The conventional compact type massage unit as described above is short in length, and the user often feels fatigue on his (or her) hand and arm to hold the massage unit because the vibrator piece must be directly applied on the desired site of the user's body. Particularly, the user finds it difficult to turn round the hand and arm to apply the unit to shoulder, back, etc. or to perform massage for long time because he is forced to take unnatural posture, and the user often needs help from another person. There has been no type of massage unit, which permits the user to perform massage while he (or her) continues to do office work, cooking or studying on desk. In the large-scale massage unit of backrest type or upwardfacing type as described above, the unit is expensive and requires considerable space, and the user cannot perform massage during office work, cooking or studying on desk.

The present invention has been conceived with the purpose of solving these problems. The object of this invention is to provide a massage unit, which is long and flexible and can be easily applied by the user to the desired site of his body without feeling fatigue on his hand and arm even when massaging for long time, and the user can continue his work or learning without interrupting the massage.

DETAILED DESCRIPTION OF THE EMBODIMENTS

Figure 1:
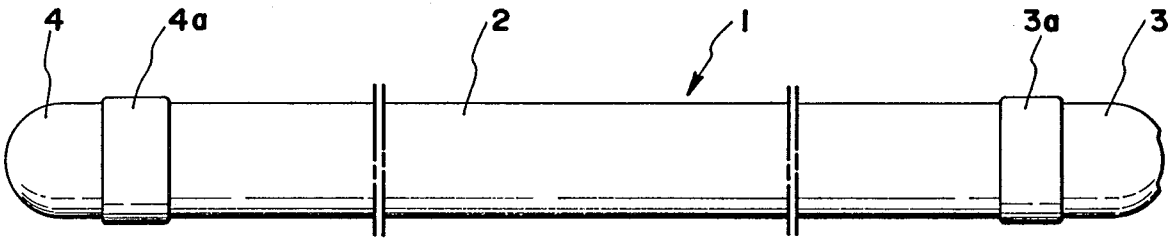
FIG. 1 is a partial cutaway front view of an embodiment according to the present invention.

In the following, the detailed features of the present invention will be described in conjunction with the various embodiments:

In FIG. 1, 1 represents the massage unit, which consists of a long cylindrical piece 2 having a flexible hollow body. On both ends of said long piece 2, caps 3 and 4 are mounted in freely removable manner to facilitate the insertion and replacement of batteries. 3*a* and 4*a* show the ferrules formed on the caps 3 and 4 respectively.

Figure 2:
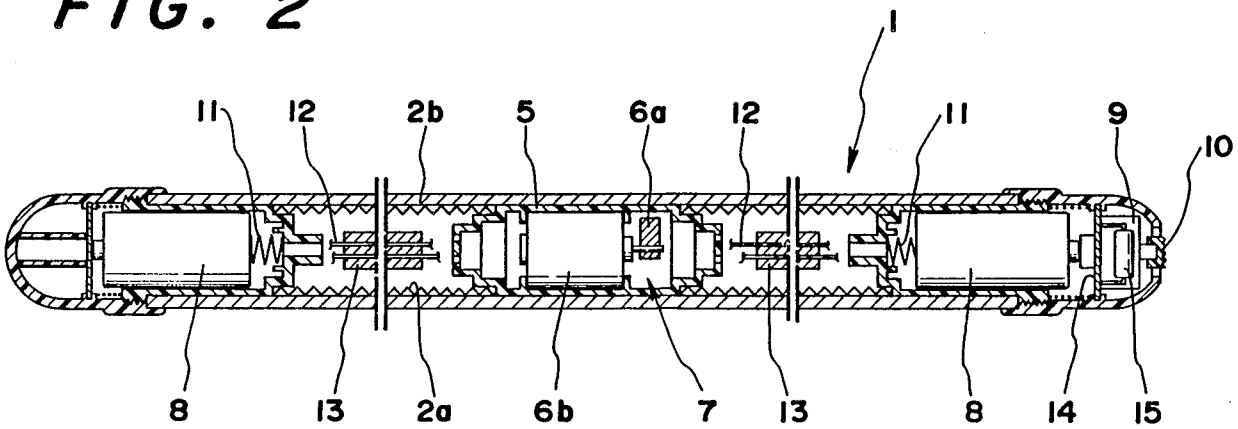
FIG. 2 is a schematic sectional view of a massage unit shown in FIG. 1.

The long piece 2 as described above has a cylindrical shape. It consists of a cylindrical bellows 2*a* made of soft synthetic resin such as soft vinyl chloride, as shown in FIG. 2, and the external portion of the bellows is covered with elastic material 2*b* such as synthetic resin foam material, rubber material, etc. 5 represents a vibration generator and is allocated approximately at the center of the long piece 2. It is provided with a vibrator 7 consisting of a motor 6*b*, in which an eccentric weight (6*a*) is mounted on the axis. The vibration generated by the rotation of this motor 6*b* is transmitted to the entire body of the long piece 2 through the vibration generator 5. The vibrator can be of any type as long as it is provided with a function to generate vibration an electromagnetic coil.

Figure 3:
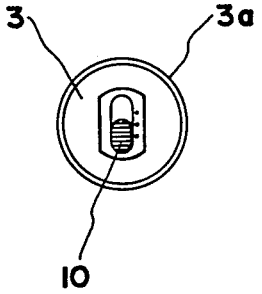
FIG. 3 is a side elevation of the massage unit by this invention.

Next, internal structure of the massage unit according to this invention will be described in conjunction with FIG. 2 and FIG. 3. A knob 10 is furnished on the end surface of the cap (3) as shown in FIG. 3. By sliding the knob 1, a switch 9 is changed over to set the vibration generator 5 to "stop", "mild vibration" or "strong vibration".

To provide the driving power for the vibration generator 5, two batteries 8 are connected in series through a terminal 11 and appropriate wiring 12 respectively, and one end of the wiring is connected to a switch baseplate 14 furnished with the switch 9 in order to supply power. The wiring 12 is arranged with ample space between the terminal 11 and the motor in the hollow portion of the long piece 2 so that it may not be unnaturally bent.

When the knob 10 of the above-mentioned switch 9 is turned from "stop" to "mild vibration", the electric current from the battery 8 is supplied to the motor 6*b* through the load resistance 15 connected with the switch baseplate 14, thereby lowering the voltage. Then, the motor 6*b* is rotated more slowly than normal, and the vibration generator 5 generates the vibration with lower frequency. When the knob 10 is turned to "strong vibration", the current flows without passing through the load resistance 15 and is supplied to the motor 6*b* without lowering the voltage. The motor is then rotated quickly, and the vibration generator 5 produces the vibration of higher frequency. Thus, strong or mild vibration can be selected by the setting of the knob.

Figure 5:
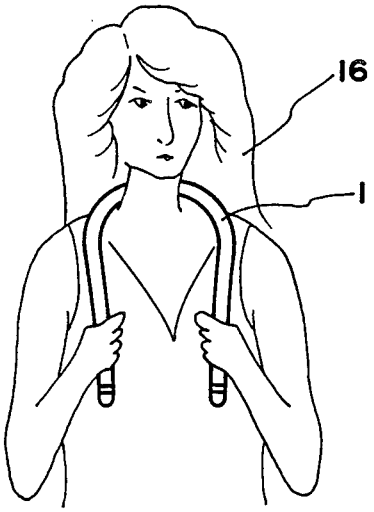
FIG. 5 is a schematic front view, showing the massage unit when it is in use.

When the massage unit according to this invention is turned round the neck, arm, leg, trunk or waist of the user and when the user holds both ends of the unit and applies it softly on the affected site, vibration from the vibration generator 5 is directly transmitted through the elastic material 2*b* when the user pulls both hands strongly. When the user crosses both hands, the massage unit can be wound round the affected site of his (or her) body so that the effects of the massage are given as desired. As shown in FIG. 2, the massage unit by this invention is provided with full flexibility because the cylindrical bellows 2*a*, made of soft synthetic resin such as soft vinyl chloride, and its exterior are covered with the elastic material 2*b* such as synthetic resin foam material, rubber material, etc. Accordingly, the user 16 can freely apply the unit to any affected site as desired by simply applying his (or her) hand, as shown in FIG. 5. Since the external portion of the long piece 2 is covered with the above-mentioned elastic material, very soft contact of the massage unit on human body is assured.

Figure 4:
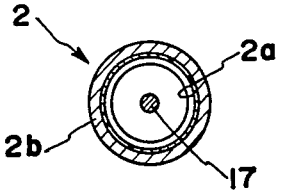
FIG. 4 is a schematic longitudinal sectional view of another embodiment of the present invention.

The embodiment shown in FIG. 4 represents a long cylindrical piece, in which a plastically deformable wire material 17 made of aluminum wire is provided. A wire material with little shape-memory is used so that the user can bend the long cylindrical piece to a desired shape, which bent shape is retained. In other words, according to this embodiment, the massage unit can be held in the bent position by the action of the plastically deformable wire material 17, and it remains in the bent position when it is turned round the neck, arm, etc. The user 16 does not have to hold both ends of the massage unit now because it is kept in the bent position, and is wound round the affected site. The user can continue office work, cooking, learning, etc., fully enjoying the effects of the massage.

As explained above, the massage unit according to the present invention is long and flexible, and the user finds no difficulty in applying it to any affected site, whether it is easy or hard to reach, including each one of the shoulder, back, etc., which is often difficult to reach by hand or arm. When the user has to hold the unit for long time for massaging, he (or she) feels no fatigue, and various effects of massage such as the relaxing of muscle stiffness, the enhancement of blood circulation, the improvement of metabolism, etc. can be given to the full extent. According to the embodiment as shown in FIG. 4, the unit can be turned round the affected site on the user's body and held there. Accordingly, a housewife can perform massage by herself while she continues to do cooking work, and the students can massage their heads, shoulders, waists, etc. when studying at the desk. The users can perform massage without interrupting their work, irrespective of whether they are working indoors or outdoors.

With the massage unit by this invention, the users can freely set the vibrator to "strong" or "mild" vibration as necessary. Since the massage vibration generated by the vibration generator is transmitted to the entire portion of the long piece, massage effects can be given to the body of the user extensively and in very efficient manner.

What is claimed is:

1. A massage unit comprising:

an elongated elastically deformable hollow cylinder;

vibrator means disposed in said elongated elastically deformable cylinder for producing vibrations for vibrating said elongated elastically deformable hollow cylinder;

switch means attached to said vibrator means for turning said vibrator means on and off; and elastically deformable cylinder shape retaining means attached to and extending along substantially the entire length of said elongated elastically deformable hollow cylinder for retaining the cylindrical shape of said elongated elastically deformable hollow cylinder when said elastically deformable shape retaining means and said elongated elastically deformable hollow cylinder are bent to a desired shape, said elastically deformable cylinder shape retaining means being an elongated hollow cylindrical bellows disposed within said elongated elastically deformable hollow cylinder, and said elongated hollow cylindrical bellows being a synthetic resin material.

2. A device as in claim 1, wherein said elongated elastically deformable hollow cylinder is a material selected from the group consisting of synthetic resin foam material and rubber.

3. A device as in claim 1, further comprising a plastically deformable massage unit configuration shape retaining means for retaining said massage unit in a particular configuration when said massage unit is bent to a desired shape, said plastically deformable massage unit configuration shape retaining means being an elongated piece of metal extending substantially the entire length of said elastically deformable hollow cylinder, and said elongated piece of metal being disposed within said elastically deformable hollow cylinder.

4. A device as in claim 3, wherein said elongated elastically deformable hollow cylinder is a material selected from the group consisting of synthetic resin foam material and rubber.

5. A device as in claim 4, wherein said elastically deformable hollow cylinder has a first and a second end, said vibrator means includes an electric motor and means for retaining batteries for powering said electric motor, and at least one removable cap is attached to an at least one of said first and second ends of said elongated elastically deformable hollow cylinder for providing access to batteries retained by said battery retaining means.

* * * * *